United States Patent [19]

Gariboldi et al.

[11] 3,996,768

[45] Dec. 14, 1976

[54] PRODUCTION OF TIGHTS ON A CIRCULAR KNITTING MACHINE

[75] Inventors: Franco Gariboldi, Condove (Turin); Ettore Negri, Florence, both of Italy

[73] Assignee: Macchine Tessili Circolari Matec S.p.A., Rome, Italy

[22] Filed: Aug. 18, 1975

[21] Appl. No.: 605,384

[30] Foreign Application Priority Data

Aug. 27, 1974 Italy ..... 9556/74

[52] U.S. Cl. ..... 66/8; 66/177

[51] Int. Cl.[2] ..... D04B 9/00; A41B 9/02; A41B 9/04; A41B 9/10

[58] Field of Search ..... 66/175–177, 66/8

[56] References Cited

UNITED STATES PATENTS

| | | | |
|---|---|---|---|
| 3,109,300 | 11/1963 | Garrou et al. | 66/177 |
| 3,109,301 | 11/1963 | Garrou et al. | 66/177 |
| 3,748,870 | 7/1973 | Fregeolle | 66/177 |
| 3,802,229 | 4/1974 | Fregeolle | 66/177 |
| 3,815,385 | 6/1974 | Gariboldi | 66/177 X |
| 3,937,040 | 2/1976 | Negri | 66/177 |
| 3,938,355 | 2/1976 | Conti | 66/177 |
| R27,886 | 1/1974 | Johnson | 66/177 |

*Primary Examiner*—Ronald Feldbaum
*Attorney, Agent, or Firm*—Haseltine, Lake & Waters

[57] ABSTRACT

In the production of tights on a circular knitting machine, the needle cylinder is operated with continuous motion to form a first tubular leg portion. The needles along a first arc are then excluded, and a trapezoidal fabric flap is knitted along a second arc, explementary to the first arc, using oscillating motion of the needle cylinder, needles being progressively excluded along third and fourth arcs, at each end of the second arc whereby to form inclined sides of the flap. Knitting of the flap is completed along a fifth arc defined between the ends of the third and fourth arcs. A second trapezoidal fabric flap is knitted along the fifth arc, needles being progressively included along the third and fourth arcs. The second flap is connected to the first flap during knitting and the two flaps form the pants portion of the tights. After completion of the second flap, a second tubular leg portion is formed using continuous motion of the needle cylinder.

10 Claims, 13 Drawing Figures

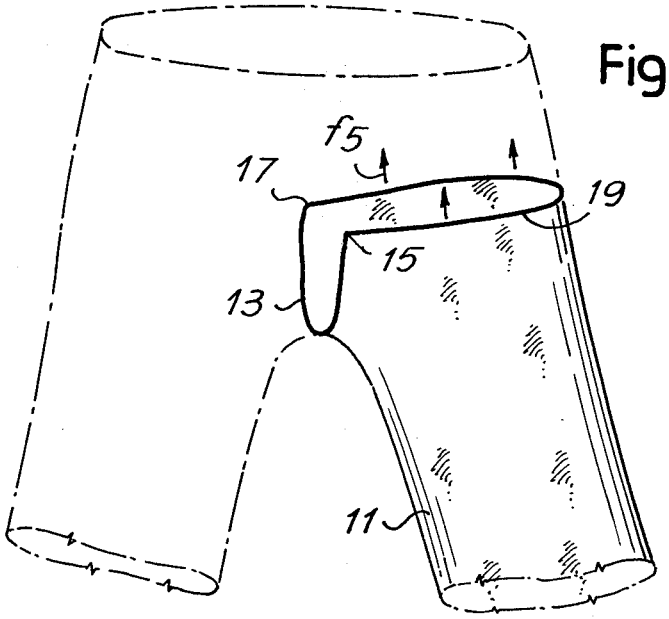
Fig.6
Fig.7
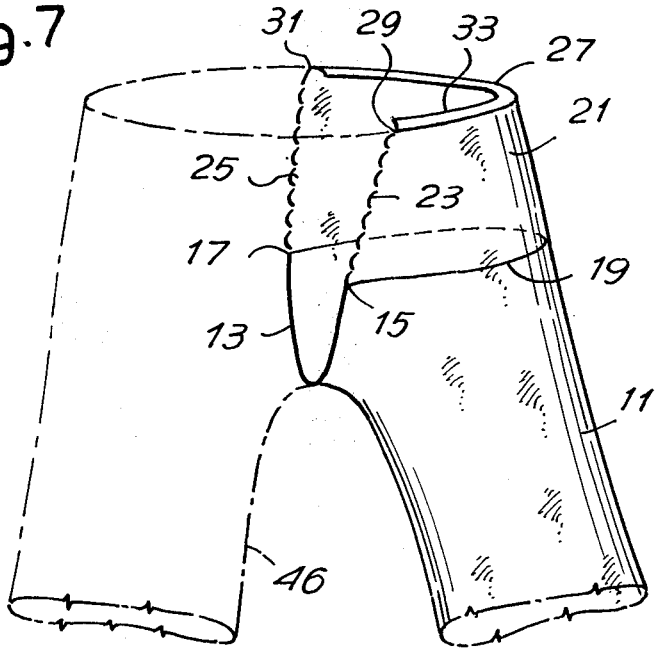

140
127
25
33
21
41
17
23
11
43
15
19
13
46

225A
230
233
240
226
227
229
241
223A
225
224
221
17
223
43
15
19
13
11
46

PRODUCTION OF TIGHTS ON A CIRCULAR KNITTING MACHINE

FIELD OF THE INVENTION

The present invention relates to the production of tights on a circular knitting machine.

SUMMARY OF THE INVENTION

According to the invention, there is provided a process for knitting tights on a circular knitting machine comprising a needle cylinder having needles, said process comprising the steps of forming a first tubular portion of fabric using continuous motion of the needle cylinder, excluding needles along a first, relatively small, needle arc with the stitches being retained by the excluded needles, knitting a first trapezoidal fabric flap along a second needle arc explementary to the first arc, using an oscillating motion of the needle cylinder, excluding needles from the ends of the second arc during knitting of the first flap, said needles being excluded along relatively small third and fourth arcs at the end portions of the second arc and the stitches being retained on the excluded needles, forming an end edge of the flap along a fifth needle arc lying on the second arc between the adjacent ends of the third and fourth arcs and abandoning the edge from the needles of the fifth arc, forming a second trapezoidal fabric flap using an oscillating motion of the needle cylinder, said second flap being formed by knitting an end edge along the fifth arc, progressively inserting needles along the third and fourth arcs whereby the sides of the second flap are connected to the sides of the first flap, said second flap being completed when all of the needles of the third and fourth arcs have been inserted, and forming a second tubular portion along the first and second arcs using continuous motion of the needle cylinder, the two tubular portions forming respective legs of the tights, and the said edges of the two flaps defining a waist portion of the tights.

During the formation of the two flaps, the needles are preferably excluded and inserted singly, at each oscillation of the needle cylinder, at every second oscillation of the needle cylinder, or at every third or more oscillations of the needle cylinder, to obtain the desired structure.

The exclusion and insertion of needles along one of the third and fourth arcs may occur asymmetrically with respect to the exclusion and insertion of the needles along the other of these two arcs in order to obtain different fabric structure at the front and at the rear of the tights.

The rates at which the needles are excluded and inserted may differ, and the exclusion or insertion rate may vary during formation of the respective flap. In particular, the needle exclusion rate and the needle insertion rate may be greater during the formation of those portions of the flaps which lie adjacent the waist of the tights whereby to increase the strength of the connection between the flaps in this part of the article.

BRIEF DESCRIPTION OF THE DRAWINGS

Embodiments of the invention will now be described, by way of example only, with reference to the accompanying diagrammatic drawings in which:

FIGS. 6 to 9 are fragmentary perspective views showing the tights at different stages during their production;

DESCRIPTION OF THE PREFERRED EMBODIMENTS

Figure 1:
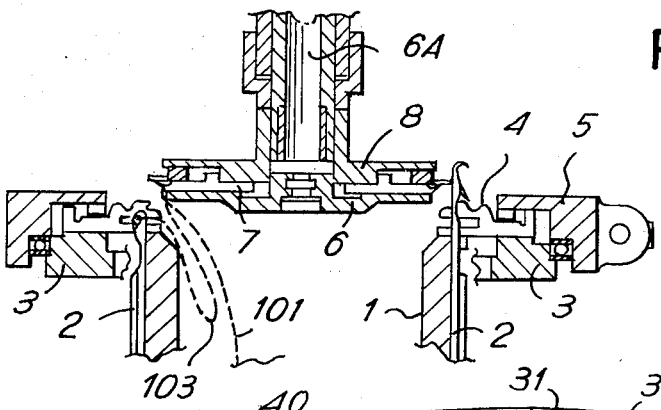
FIG. 1 is a schematic cross section of the upper part of the needle cylinder of a circular knitting machine.
Figure 2:
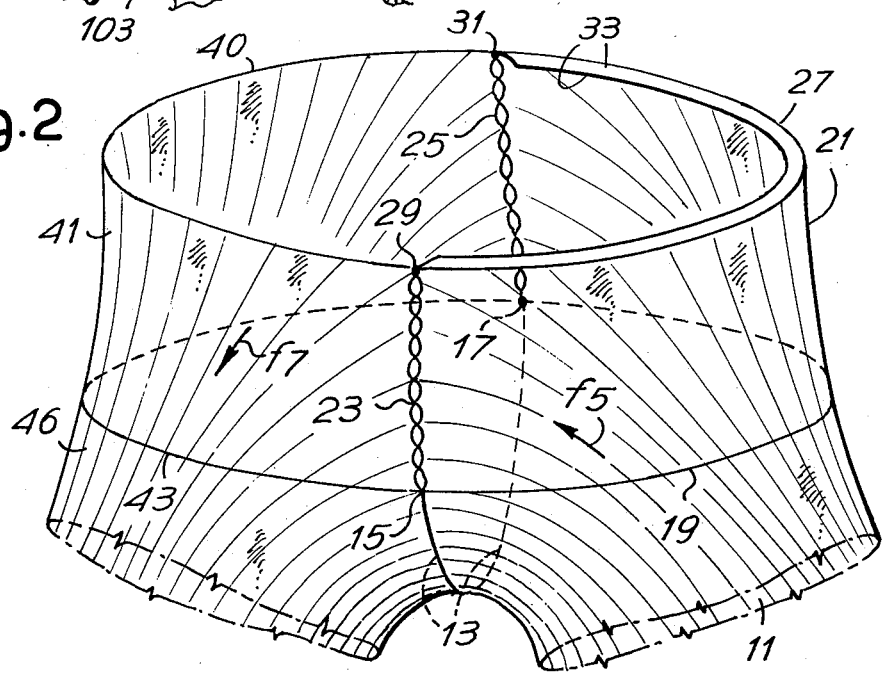
FIG. 2 is a fragmentary perspective view of tights produced by a process in accordance with the invention.

There is shown in FIG. 1 the upper part of a needle cylinder 1 of a circular knitting machine. The needle cylinder has longitudinal grooves or tricks in which are mounted needles 2 which are operated to accomplish the functions to be described hereinafter. An annular structure 3 surrounds the needle cyclinder 1 and is rigid therewith. Radial sinkers 4 are slidable in the structure 3 and are operated by cam profiles carried by an annular element 5 surrounding the annular structure 3. A welt dial 6 adjacent the upper end of the cylinder 1 is driven by a shaft 6A coaxial with the cylinder 1 and rotating synchronously therewith. The dial 6 carries, within radial seats, a plurality of hooks 7 of conventional type having butts which are operated by cam profiles carried by a stationary annular element 8 arranged above the dial 6 and around the shaft 6A.

In FIGS. 2 to 11, 11 denotes a first tubular portion of a pair of tights knitted on the machine shown in FIG. 1, the portion 11 forming a leg and a part of the pants portion of the tights. This first portion 11 is knitted with a continuous motion of the needle cylinder 1 and the extent of this portion is shown in FIG. 6. After this portion has been knitted, the needles extending along an edge 13, which corresponds to a needle arc A13 (FIG. 3) defined between points 15 and ,7, are raised into an excluded or inoperative position; the arc A13 may extend over approximately 90°–100°, and may be equivalent to approximately 100 needles in a machine with a cylinder having 400 needles. Knitting of the article is then continued along a needle arc A19, which is explementary to the arc A13, using an oscillating motion of the needle cylinder in such a manner as to form a fabric flap 21 which has a trapezoidal shape. This flap 21 extends from a line 19 at the end of the portion 11 and is formed by progressively decreasing the effective length of the needle arc along which knitting occurs. More particularly, the arc A19 progressively reduced by progressively excluding needles along two arcs A23 and A25 at each end of the arc A19, the arc A23 extending between the point 15 and a point 29, and the arc A26 extending between the point 17 and a point 31. Exclusion of the needles starts at the points 15 and 17 by lifting the needles and continues along the arcs A23 and A25 to the points 29 and 31 respectively. In this manner there are formed inclined lateral sides 23 and 25 of the flap 21. The flap 21 proceeds from the line 19 in the direction indicated by the arrows $f_5$ to an edge 27, which extends between the points 29 and 31, which also determine the ends of the sides 23 and 25. The edge 27 corresponds to the needle arc A27 shown in FIG. 3.

Figure 3:
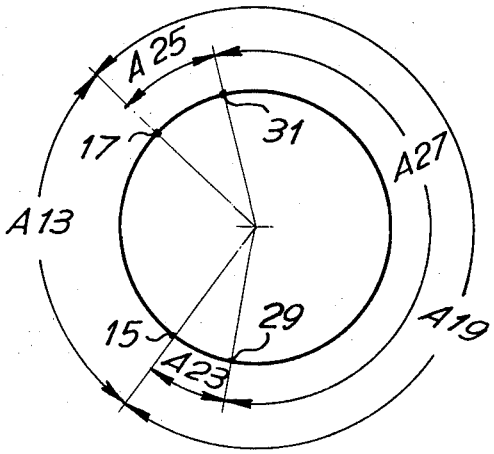
FIG. 3 schematically indicates the manner in which the needles of the needle cylinder are set up to carry out the process.
Figure 4:
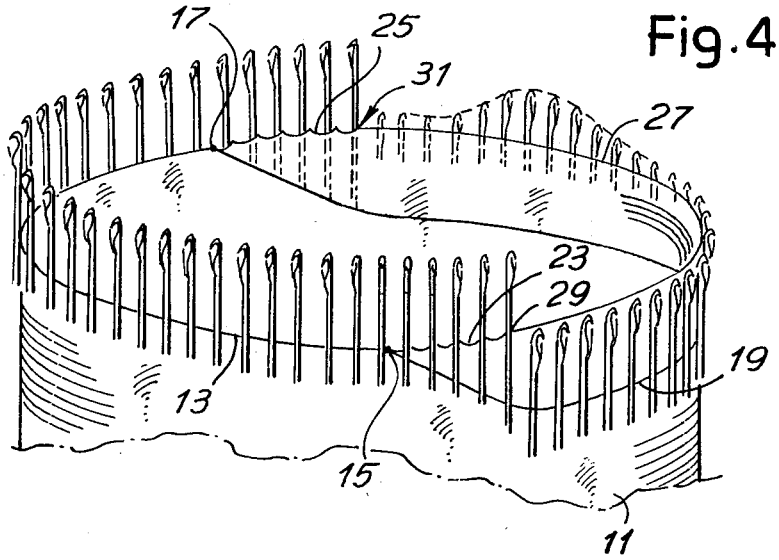
FIGS. 4 and 5 are fragmentary perspective views illustrating two stages in the production of the tights shown in FIG. 2.

During the forming of the flap 21, the needle arc A19 is only gradually reduced along the arcs A23 and A25; in other words, the number of needles excluded at the ends of the needle arc is limited with respect to the number of courses of stitches being formed. For instance, there can be excluded one needle at each end of the arc at each oscillation of the needle cylinder (with the forming of two courses of stitches) or at every second oscillation (with the forming of four courses of stitches) or at every third or more oscillation. With this gradual decrease in the number of needles the sides 23 and 25 of the flap 21 are only slightly inclined, the difference between the arcs A19 and A27 being relatively small; as shown in FIG. 3, the arc A27 extends over an angle greater than 180°.

The stitches formed finally by excluded needles remain attached to those needles, such as the needles of the arc A13.

When the edge 27 is reached, the needles between the points 29 and 31 are actuated in such a manner as to form an end flap 33 of a type known per se, for example a so-called anti-ravel tab, to permit the needles to abandon the fabric along the arc A27.

When the flap has been formed along the edge 27, excluded needles are present along the arcs A23, A13 and A25, in raised positions, whereas cleared needles, i.e. needles free of fabric are located along the arc A27 between the points 29 and 31; the needles along the arcs A23, A13 and A25 maintain the fabric in a suspended condition. The parts of the tights formed by the end of this stage are indicated in solid lines in FIG. 7.

Figure 5:
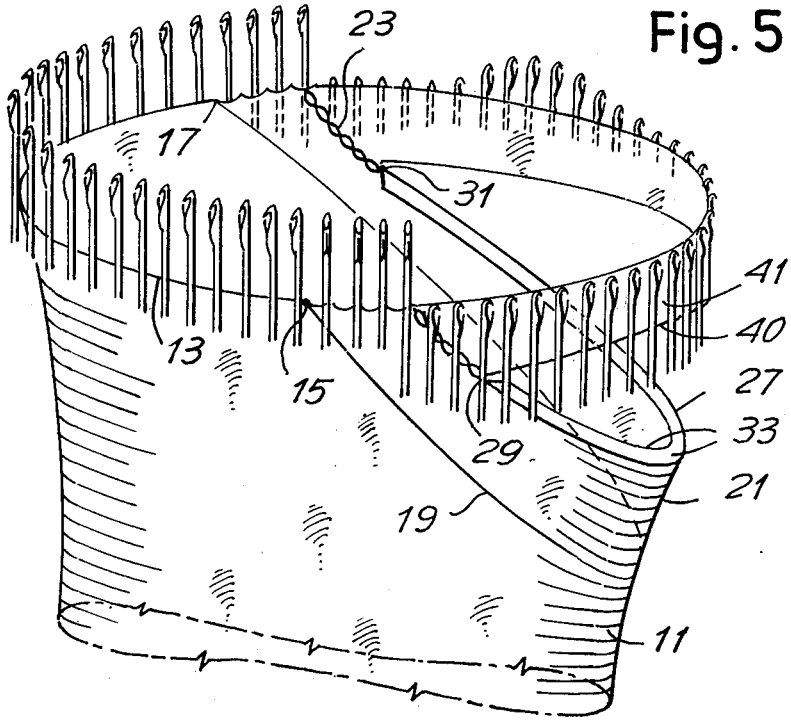
Figure 8:
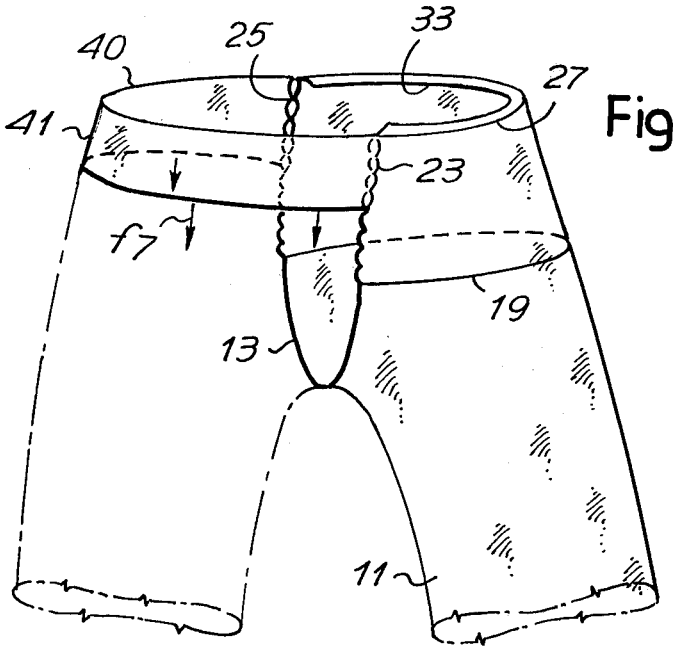

At this point, working is resumed along the needle arc A27, with oscillating motion of the needle cylinder to begin in a conventional manner an edge 40 of a second trapezoidal fabric flap 41, the edge 40 being symmetrical to the edge 27. The edge 40 is finished with a flap corresponding to that of the edge 27 if these edges are prominent in the finished article. If, however, these edges are not prominent, the edge 40 may be formed in a conventional manner without any particular finish. The flap 41, which begins at the edge 40, is formed according to the arrows $f_7$ (FIG. 8) using oscillating motion of the needle cylinder and with gradual increasing course length effected by the progressive insertion of needles, starting from the points 29 and 31, along the arcs A23 and A25, these inserted needles creating a knitted connection with the sides 23 and 25 of the flap 21. The resulting flap 41 (FIG. 9) is substantially symmetrical to the flap 21 and terminates along a line 43 between the points 15 and 17, with a development along the needle arc A19. The rate at which the needles are inserted corresponds to that at which the needles were excluded during the formation of the flap 21. An intermediate stage during the formation of the flap 41 is shown in FIGS. 5 and 8.

Figure 9:
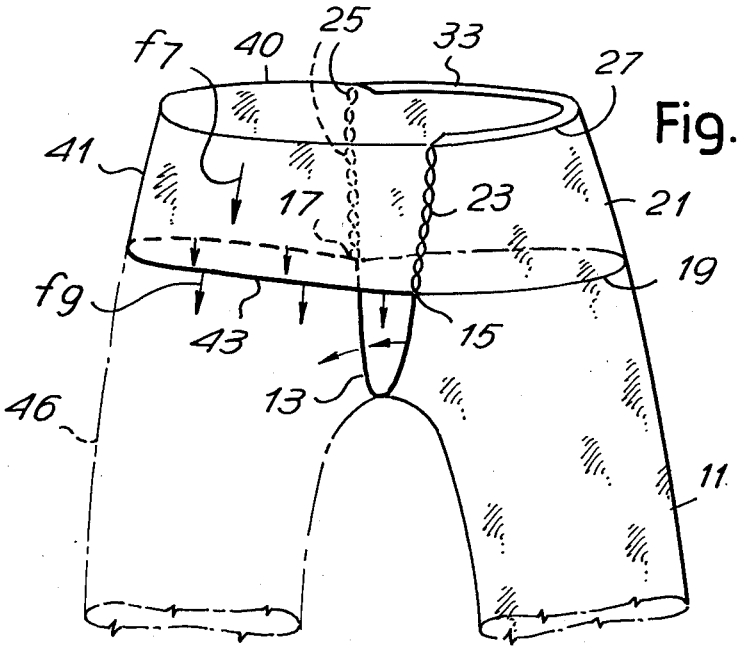

The parts of the tights formed by the end of this stage are indicated in solid lines in FIG. 9. At this point, along the edge defined by the line 43, (that is along the needle arc A19) and along the edge defined by the line 13 (that is along the arc A13 where previously the fabric was suspended from the corresponding excluded needles, during the formation of the flaps 21 and 41), knitting is resumed with a continuous circular motion and with all the needles whereby to form, in the direction of the arrows $f_9$, a second tubular portion 46. This portion is symmetrical to the portion 11 and constitutes the other leg and the adjacent part of the pants portion.

Figure 10:
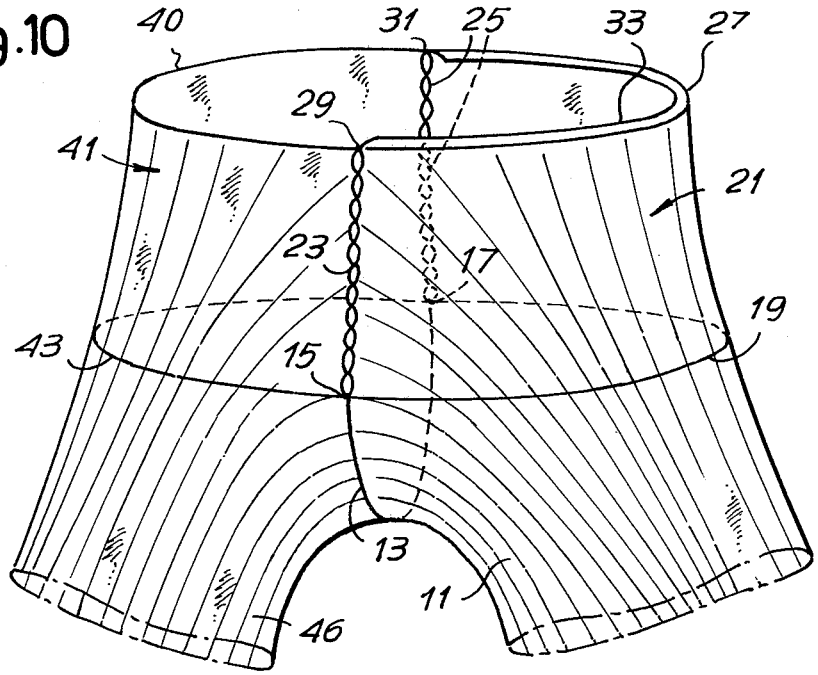
FIGS. 10 and 11 are fragmentary perspective views indicating respectively the rows of stitches formed by the same needle, and the courses of stitches formed by the same yarn.
Figure 11:
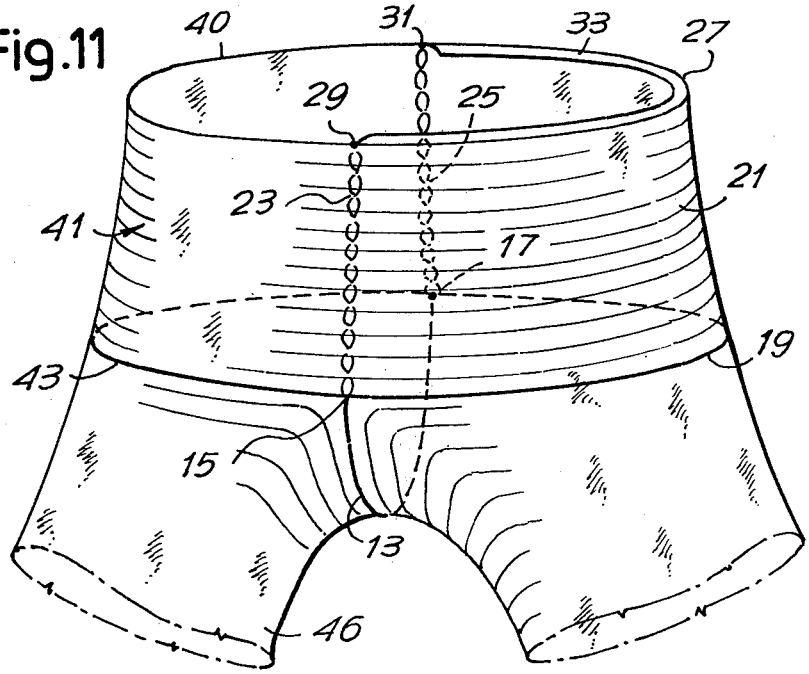

In FIG. 10 there is indicated schematically the rows of stitches formed by individual needles and in FIG. 11 there is indicated schematically the courses of stitches formed by adjacent needles with the thread of the same feed.

The process described above provides a simple structure and permits fast production rates. The needle arc indicated by A13 — the needles of which remain inactive during the formation of the major part of the pants portion ,— may be relatively small. This, firstly, allows the arc A19 to be relatively large with the result that the edges 19 and 43 have a relatively large developed length; this also permits an increase in the number of courses and thus in the height in the flaps 21 and 41 in such a manner as to increase the length of the crutch part, as this length is formed by the sum of the length of the edge 13 (arc A13) plus twice the height of the flaps 21 and 41. In this manner a relatively large waist measurement, defined by the sum of the edges 27 and 40 (corresponding to twice the length of the arc A27), can be maintained. Notwithstanding the height of the flaps 21 and 41 and thus notwithstanding the large number of courses required for forming these flaps, the difference between the arc A19 and the arc A27 is relatively small. Although the arcs A23 and A25 are consequently small, it is possible to connect the two flaps 21 and 41 along the sides 23 and 25 of the flap 21, during the formation of the flap 41. In this way the pants portion comes out of the machine already finished. The small length of the arcs A23 and A25 permits a large length of the arc A27 and thus a large waist measurement. A large crotch length is thus obtained without substantially decreasing the waist measurement.

Figure 12:
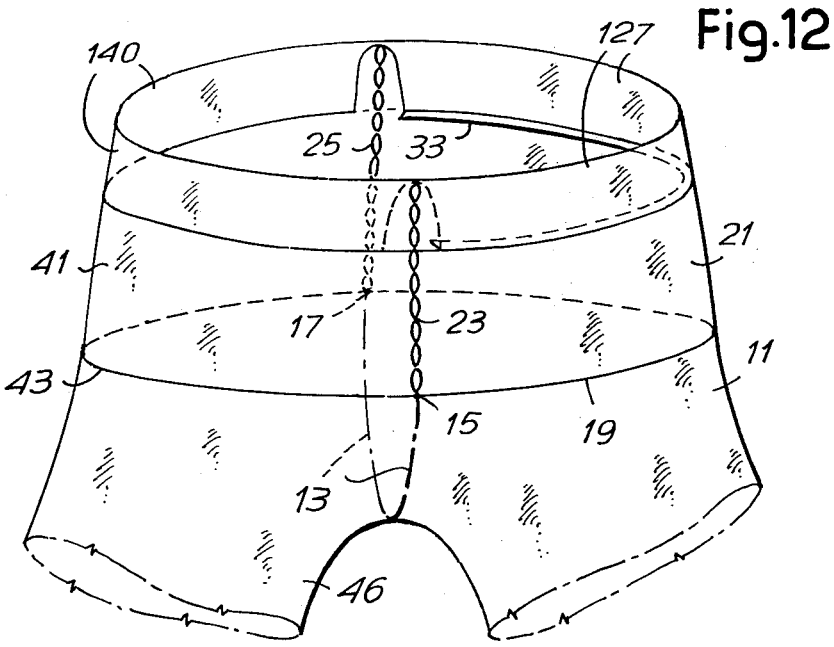
FIG. 12 is a fragmentary perspective view showing a modified form of tights.

In FIG. 12 there is shown an embodiment which is slightly modified with respect to the preceding embodiment, as regards the finish along the waist. In this embodiment, along those edges of the flaps 21 and 41, corresponding to the edges 27 and 40 of the previous embodiment, there are formed sheath-like or tubular rims 127 and 140 in a manner known per se. Thus the finish of the waist is better than that of the previous embodiment; in order to avoid a reduction of the height of the pants portion, that is height of the flaps 21 and 41, the rims 127 and 140 are made relatively narrow by using only a very small number of courses to form these rims.

Figure 13:
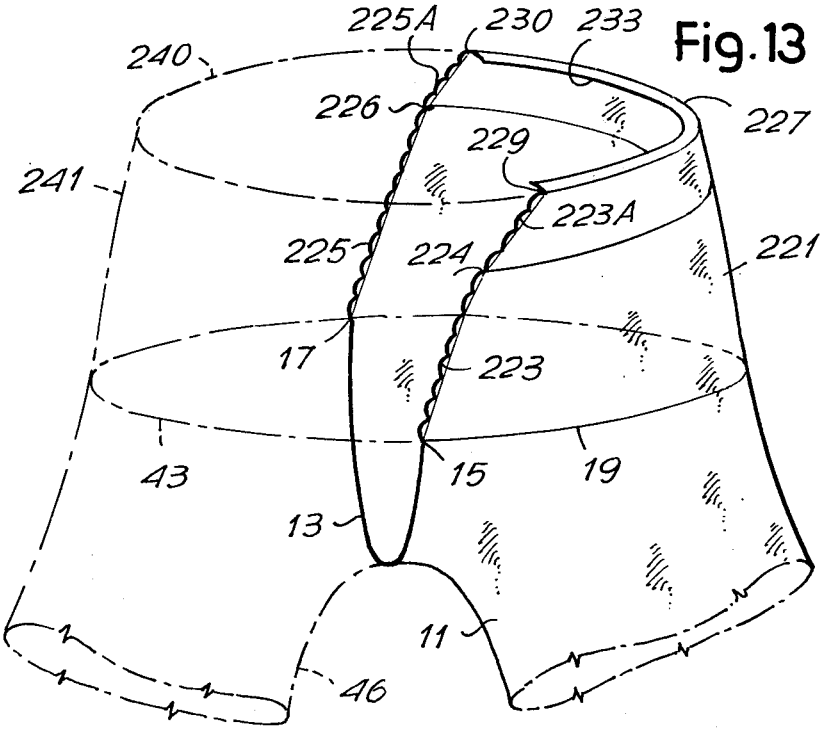
FIG. 13 is a fragmentary perspective view showing another modified form of the tights.

The embodiment of FIG. 13 is provided by modifying the rate and manner at which the needles are excluded (and ulitmately reinserted) along the arcs A23 and A25, to obtain a desired effect. In this embodiment, the needles are excluded and ultimately reinserted during the formation of flaps 221 and 241, corresponding to the flaps 21 and 41, so as to obtain an increased density of the connections between the contiguous sides of the flaps 221 and 241 adjacent the waist, which is constituted by edges 227 and 240 corresponding to edges 27 and 40. For this purpose the inclined sides of the flaps 221 and 241, along which sides the two flaps are connected, are divided into two portions 223, 223A and 225, 225A respectively. Between the points 15 and 224, and between the points 17 and 226, the portions 223 and 225 are respectively formed with a reduced rate of exclusion and subsequent inclusion of the needles, while between the points 224 and 229, and 226 and 230, the portions 223A and 225A are repsectively formed with an increased rate of exclusion and subsequent reinsertion of the needles. Consequently along the portions 223A and 225A (which have a greater inclination than the portions 223 and 225, and thus than the sides 23 and 25 of the previous embodiment), the connection between the flaps 221 and 241 is more frequent and thus more compact. Thus there is provided a greater strength of the connections in the part of the pants portion subject to the greatest stress, that is the portion adjacent to the waist, while along the portions 223 and 225, the strength of the connection does not need to be very strong owing to the smaller stress exerted on this part of the pants portion.

In alternative arrangements yarns may be replaced, and/or additional yarns may be incorporated, and/or the manner in which the yarns are interlaced may be modified to obtain a greater elasticity adjacent the waist, for example in the zone of the rims 227, 240 of FIG. 13.

As described previously, during the formation of the flap 21 (or the equivalent such as 221), several courses of stitches (for example six or eight) may be formed with an oscillating motion between the exclusion of one needle and that of a subsequent adjacent needle; while these courses are being formed the last excluded needle may be temporarily reinserted in such a manner as to form a supplementary connection of the inclined side of the first flap (21 or 221) to that of the second flap (41 or 241) in each loop which is formed during the knitting of the second flap (41 or 241); this has the purpose of reducing the amplitude of the single loops. Similar arrangements may be used during the formation of the second flap (41 or 241), by temporarily inserting a needle before its final reinsertion during the formation of at least one course of the several courses (for instance six or eight) which are knitted between the final reinsertion of a previous needle and the final reinsertion of above considered needle.

The process particularly described is relatively simple and rapid. In fact the process has only two oscillating working stages (to form the two trapezoidal flaps) between the two working stages with continuous motion. On the other hand, the article thus formed has a sufficient circumferential development in the pants portion and in particular at the waist thereof, despite having a relatively long crotch length. This is due to the length of the needle arc used for forming the flaps, and to the length of these flaps; the latter may be formed with many courses (to increase the crotch length) without effecting a substantial reduction of the waist measurement, owing to the fact that the stitches are "decreased" and ultimately "increased" after a relatively large number of oscillating courses; in this case, one may adopt the system indicated to reduce the amplitude of the "holes" otherwise formed along the matching lines of the sides 23 and 25 of the first flap 21 to the corresponding sides of the second flap 41.

What is claimed is:

1. A process for knitting tights on a circular knitting machine comprising a needle cylinder having needles, said process comprising the steps of forming a first tubular portion of fabric using continuous motion of the needle cylinder, excluding needles along a first, relatively small, needle arc with the stitches being retained by the excluded needles, knitting a first trapezoidal fabric flap along a second needle arc explementary to the first arc, using an oscillating motion of the needle cylinder, excluding needles from the ends of the second arc during knitting of the first flap, said needles being excluded along relatively small third and fourth arcs at the end portions of the second arc and the stitches being retained on the excluded needles, forming an end edge of the flap along a fifth needle arc lying on the second arc between the adjacent ends of the third and fourth arcs and abandoning the edge from the needles of the fifth arc, forming a second trapezoidal fabric flap using an oscillating motion of the needle cylinder, said second flap being formed by knitting an end edge along the fifth arc, progressively inserting needles along the third and fourth arcs whereby the sides of the second flap are connected to the sides of the first flap, said second flap being completed when all of the needles of the third and fourth arcs have been inserted, and forming a second tubular portion along the first and second arcs using continuous motion of the needle cylinder, the two tubular portions forming respective legs of the tights, and the said edges of the two flaps defining a waist portion of the tights.

2. A process according to claim 1, wherein during the formation of the flaps, the needles are excluded and inserted singly.

3. A process according to claim 1, wherein the exclusion and insertion of the needles along one of the third and fourth arcs occurs is effected asymetrically with respect to the exclusion and insertion of the needles along the other of the third and fourth arcs, whereby to obtain different fabric structures at the front and rear of the tights.

4. A process according to claim 1, wherein the rate at which the needles are excluded and inserted along the third and fourth arcs is varied during the knitting of the repsective flaps.

5. A process according to claim 4, wherein the rate of exclusion of the needles is greatest when forming the final part of the first flap, and the rate of inclusion of the needles is greatest when forming the initial part of the second flap.

6. A process according to claim 1, wherein during the formation of the first flap, several courses of stitches are formed between the exclusion of adjacent needles, and a previously excluded needle is temporarly reinserted during the formation of at least one of said courses prior to the exclusion of the subsequent needle.

7. A process according to claim 1, wherein during the formation of the second flap, several courses of stitches are formed between the insertion of adjacent needles and an excluded needle is temporarily reinserted during the formatiom of at least one of the courses between the insertion of the previous needle and the permanent insertion of that needle.

8. A process according to claim 1 comprising interlacing elastic yarn in the courses at the end edges of the trapezoidal flaps close to the waist line of the tights whereby to provide stitch courses parallel thereto.

9. A process according to claim 1 comprising forming tubular rims at the end of the trapezoidal flaps at the waist line of the tights.

10. A process according to claim 1 comprising increasing the rate of exclusion and subsequent reinsertion of the needles at the ends of the flaps to provide an increased density of connection between the contiguous sides of the flaps adjacent the waist of the tights.

* * * * *